US012139979B2

(12) United States Patent
Manttari et al.

(10) Patent No.: US 12,139,979 B2
(45) Date of Patent: Nov. 12, 2024

(54) HOMOGENIZER, ROCK DRILLING RIG AND METHOD OF SAMPLING

(71) Applicant: SANDVIK MINING AND CONSTRUCTION OY, Tampere (FI)

(72) Inventors: Maunu Manttari, Tampere (FI); Pekka Koivukunnas, Turku (FI); Lasse Tuominen, Oulunsalo (FI); Rami Raute, Turku (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 0 days.

(21) Appl. No.: 18/216,291

(22) Filed: Jun. 29, 2023

(65) Prior Publication Data

US 2024/0003206 A1 Jan. 4, 2024

(51) Int. Cl.

| | |
|---|---|
| ***E21B 21/07*** | (2006.01) |
| ***E21B 7/02*** | (2006.01) |
| ***E21B 21/015*** | (2006.01) |

(52) U.S. Cl.

CPC ..... *E21B 21/015* (2013.01); *E21B 7/025* (2013.01); *E21B 21/07* (2013.01)

(58) Field of Classification Search

CPC ..... E21B 21/015; E21B 21/07

See application file for complete search history.

(56) References Cited

U.S. PATENT DOCUMENTS

| | | | | |
|---|---|---|---|---|
| 3,460,858 | A * | 8/1969 | Wolters | E21B 17/04 285/190 |
| 2007/0177452 | A1* | 8/2007 | Aroussi | F23K 3/02 138/40 |
| 2010/0206383 | A1* | 8/2010 | Getliff | E21B 21/066 137/268 |
| 2019/0226338 | A1* | 7/2019 | Lindfors | E02D 1/02 |

FOREIGN PATENT DOCUMENTS

| | | | |
|---|---|---|---|
| AU | 2009295773 | B2 | 3/2013 |
| EP | 3029264 | A1 | 6/2016 |
| WO | 02/35052 | A1 | 5/2002 |
| WO | 2007060294 | A1 | 5/2007 |
| WO | 2010029216 | A1 | 3/2010 |

* cited by examiner

*Primary Examiner* — Giovanna Wright

(74) *Attorney, Agent, or Firm* — Corinne R. Gorski

(57) ABSTRACT

A homogenizer for homogenizing flow, a rock drilling rig, and a method for taking samples is provided. The homogenizer is mountable to a dust collecting system of the rock drilling rig and is arranged for effecting on the flow, which contains air and drilling cuttings. The homogenizer includes a channel part through which the flow is directed and at least one air jet for directing air blows to the flow for generating disturbance in the flow and to thereby homogenize particle distribution of the drilling cuttings in the flow.

10 Claims, 4 Drawing Sheets

HOMOGENIZER, ROCK DRILLING RIG AND METHOD OF SAMPLING

RELATED APPLICATION DATA

This application claims priority under 35 U.S.C. § 119 to EP Patent Application No. 22182453.5, filed on Jul. 1, 2022, which the entirety thereof is incorporated herein by reference.

TECHNICAL FIELD

The present disclosure relates to a homogenizer intended to be mounted to dust collecting system of rock drilling rig. The homogenizer is designed for affecting to properties of flow in the dust collecting system.

The disclosure further relates to a rock drilling rig and to a method of taking samples of drilling cuttings.

BACKGROUND

In mines and at other work sites different type of rock drilling rigs are used for drilling drill holes in rock surfaces. During the drilling process drilling cuttings are flushed out of the drill hole and are conveyed away from a drill hole opening by means of a dust collecting system.

There is a need to take samples from flow containing air and solid drilling cutting particles for analyzing the particles and properties of the rock surface being drilled. It has been noted that the solid particles do not distribute evenly in the system wherefore it is difficult to take good samples. Therefore, different flow homogenizers are designed for solving this problem. However, the known solutions have shown still some disadvantages.

SUMMARY

An object of the present disclosure is to provide a novel and improved homogenizer, rock drilling rig and method for taking samples.

An idea of the disclosed solution is that a dust collecting system of a rock drilling rig can be provided with a homogenizer for homogenizing flow containing air and drilling cuttings. The homogenizer includes a channel part through which the flow is directed and one or more air jets arranged on an inner surface of the channel part for directing air blows to the flow. The aim of the air blows is to generate disturbances in the flow and to thereby homogenize particle distribution of the drilling cuttings in the flow. In other words, the flow inside the flow channel or channel part is disturbed pneumatically by directing pressurized air in transverse direction of the flow so that the drilling cutting particles with different sizes are spread more evenly.

An advantage of the disclosed solution is that representative samples of the drilling cuttings after the homogenizer can be taken when the particles with different size are spread more evenly inside the inlet tube. This way quality of the samples can be improved and more accurate and reliable analyzing results can be achieved. A further advantage is that the disclosed solution is relatively simple and inexpensive. Since the solution does not contain any movable elements or complicated mechanisms, the solution is also durable and reliable. There are no physical objects in the homogenizer which were subjected to abrasive wearing of the drilling cutting particles. The disclosed homogenizer can also be retrofitted easily to the existing dust collecting systems of different rock drilling rigs.

A further advantage is that the disclosed solution does not narrow physically the air channel and throttle the flow. This way, undesired flow resistances in the channel can be avoided.

According to an embodiment, the number of air jets is one. In some cases, one single air jet may be sufficient to cause needed particle spreading in the flow.

According to an embodiment, there may be several air jets in the homogenizer. When several air jets are implemented, then the homogenizer can have versatile control possibilities and can be adjusted to different flow situations.

According to an embodiment, orientation and magnitude of the air blows directed to the flow can be designed case by case. Flow control simulation and modelling programs can be utilized for determining the properties of the disclosed pneumatic spreading control system.

According to an embodiment, the air jet includes a nozzle element provided with a jet orifice and is connectable to a pneumatic channel. The nozzle element further includes mounting elements for mounting to air jet to the channel part.

According to an embodiment, the air jet includes a nozzle element provided with several jet orifices.

According to an embodiment, the channel part includes a bend and the at least one air jet is located at the bend. In other words, the air blows are directed to the flow at the bend. It has been noted in experiments that the effect of the pneumatic control impacts is intensified when they occur at the bend. The use of the bend is also beneficial because there is typically a need to direct tubes and hoses of the dust collection in angular positions and especially at areas close to separators and other devices. In the bends the particles are often moved in the flow towards an outer curve side of the bend, whereby this undesirable phenomena caused by inertia of the particles can be compensated by executing the air blows.

According to an embodiment, the bend may be 90°, or substantially 90°. The bend may also be any bend between 45-135°.

According to an embodiment, the channel part or portion may in some cases be without any bend whereby the homogenizing section and the homogenizing element are located at a straight section.

According to an embodiment, the channel part includes a bend with an inner curve and an outer curve and wherein the at least one air jet is provided on the outer curve of the bend. In other words, the air blows are located at the outer curve of the bend which is the most critical point where the solid particles tend to concentrate in the flow. Directing the air blows at the outer curve side has been found to be effective.

According to an embodiment, the air jets are located only on the outer curve side of the bend.

According to an embodiment, the homogenizer includes several air jets in transverse cross-section of the channel part whereby the several air jets are orientated in different radial directions relative to each other. In other words, the combined effect of several pneumatic guiding streams can be directed to the solid particles of the flow for intensifying the desired spreading action.

According to an embodiment, the homogenizer has several air jets, which are located at a distance from each other when seen in the flow direction. In other words, there may be two, three or even more air jets one after each other.

According to an embodiment, magnitudes of the air blows of the several air jets can be controlled under control of the control unit. Thus, magnitudes of the several air blows may be equal or different relative to each other.

According to an embodiment, the homogenizer may include a nozzle arrangement provided with several nozzles and jet orifices. There may be different preassembled homogenizers with different nozzle settings whereby mounting and possible change of the homogenizer is quick and easy when so desired.

According to an embodiment, the several air jets may be oriented, for example, at 10-45° angular intervals relative to each other when seen in longitudinal direction of the channel part. The size of the angular intervals between the air jets may be similar, or different angularities may be implemented.

According to an embodiment, the magnitudes of the air blows of the at least one air jet is controllable under control of the control unit. In other words, the control unit can synchronize the air blows and the sample taking measures. It is possible to initiate the execution of the air blows before the sampling measures are started. An advantage is that the control unit can adjust the timing and co-operation between the spreading and sampling.

According to an embodiment, the magnitudes of the air blows of the at least one air jet may be controlled by controlling pressure, or rate of flow, or both.

According to an embodiment, the magnitude of pressure used in the air jets may be 3-10 bars, for example.

According to an embodiment, when the homogenizer has several air jets, wherein each of the air jets can be separately controllable. Thus, timing of the air blows, as well as magnitudes of the air blows, can be controlled by means of the control unit.

According to an embodiment, the control unit can control the spreading and sampling measures fully automatically during the rock drilling.

According to an embodiment, the disclosed solution relates to a rock drilling rig comprising: a movable carrier; at least one drilling boom mounted on the carrier and comprising a rock drilling unit provided with a rock drilling machine; a dust collecting system for removing drilling cuttings from an opening of a drilled hole, wherein the dust collecting system is provided with a suction unit, dust collecting tubing, and at least one separator for separating solid particles from flow containing air and the drilling cuttings; and at least one sampling point for taking samples of the flow. Further, the sampling point is located prior to the separator so that the flow is still unseparated at the sampling point; and there is a homogenizer in the dust collecting system preceding the sampling point. The homogenizer is in accordance with the features and embodiments disclosed herein. In other words, the sampling point is located before any separation measures for the flow have been executed. An advantage of this is that the flow, where from the samples are taken, includes all possible particles since nothing has been removed from the flow.

According to an embodiment, the disclosed solution can be implemented in different kinds of drilling techniques and purposes including, for example, production drilling and exploration drilling. The solution is suitable to be used in connection with top hammer drilling, DTH drilling and rotary drilling, for example.

According to an embodiment, the dust collecting system includes a first separator for separating coarse solid particles from the flow and a second separator for separating fine solid particles from the flow. The first separator may be located on the drilling boom whereas the second separator may be located on the carrier. The first separator may be a cyclone. The homogenizer and the sampling point are located just before the first separator.

According to an embodiment, the rock drilling rig has at least one compressor for generating pneumatic pressure to a pneumatic system and wherein the homogenizer is connected to the pneumatic system and is controllable by at least one control valve.

According to an embodiment, the disclosed solution relates also to a method of sampling in a rock drilling rig. The method comprises: drilling drill holes to a rock surface; collecting produced drilling cuttings from an opening of the drill holes during the drilling by means of a dust collecting system; and taking samples of flow containing air and drilling cuttings at a sampling point of the dust collecting system during the drilling. The method further comprises: providing the dust collecting system with a homogenizer before the sampling point; directing transverse air blows to the flow and thereby spreading drilling cutting particles in the flow to even out particle distribution of the flow; and taking the samples downstream the mentioned particle spreading. In other words, the method comprises providing one or more controlled gas streams in transverse direction of the flow of the drilling cutting particles and air for effecting to the solid particles of the flow. Thus, the solid particles can be directed in the flow in contactless manner with the help of air blows.

According to an embodiment, the method includes controlling the spreading of the solid particles in the flow by directing several air blows in different transverse directions towards the flow. In other words, the spreading and distribution of the solid particles can be intensified by implementing several air blows with different orientation.

According to an embodiment, the method includes providing the at least one air jet with continuous air flow during the selectively controlled spreading measures of the solid particles. In other words, the continuous air flow through the at least one air jet nozzle occurs during the sampling process.

According to an embodiment, the method includes directing pressure air pulses or impacts to the flow when executing the spreading of the solid particles. In other words, the air pulses, or impacts, may in some cases be beneficial for the spreading of the solid particles. The air pulses may cause desired turbulence in the flow, for example.

According to an embodiment, when there are several air jets, then each of them can be arranged to direct similar of different air pulses to the flow.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
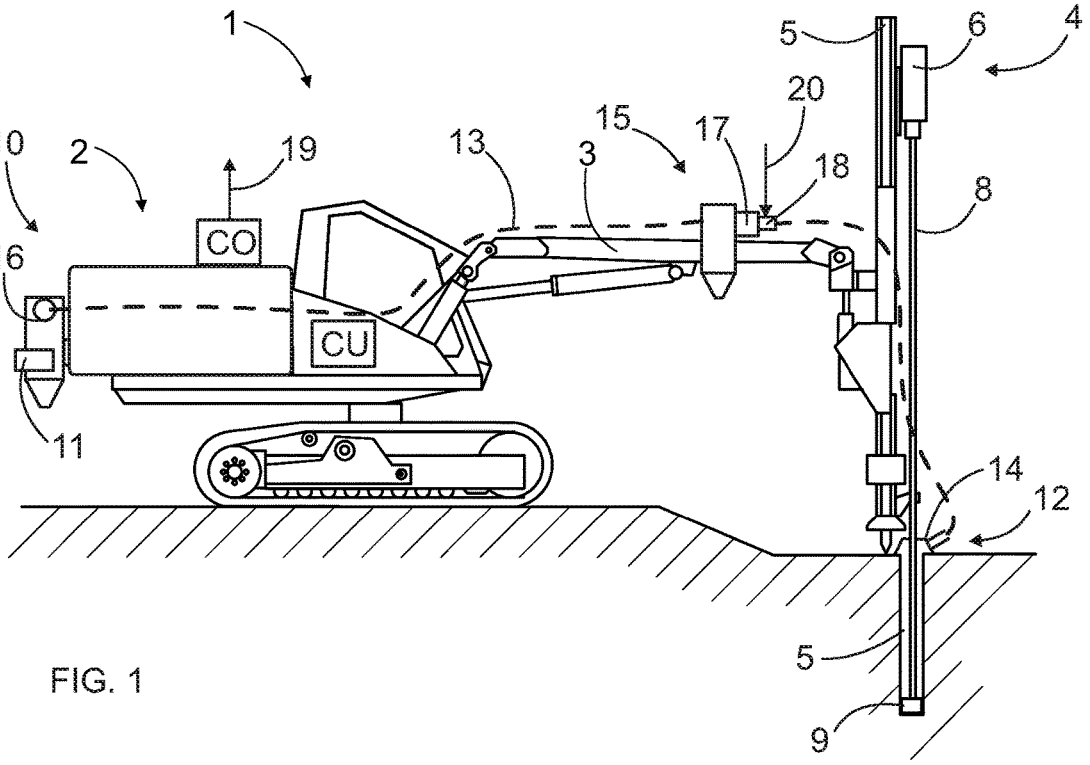
FIG. 1 is a schematic side view of a rock drilling rig for surface drilling provided with a dust collecting system and sampling means.

FIG. 1 discloses a rock drilling rig 1 including a movable carrier 2 and a drilling boom 3 mounted on the carrier 2. The drilling boom 3 is provided with a rock drilling unit 4 for drilling drill holes 5 in a rock surface. The rock drilling unit 4 includes a rock drilling machine 6, which may be arranged movably on a feed beam 7.

The rock drilling machine 6 may have an impact device and a rotating device, or alternatively it may be a rotary drilling machine and may be without any impact device. A drilling tool 8 is connected to the rock drilling machine 6 and the drilling tool 8 may have one or more drill tubes and a drill bit 9 at its free end. During the drilling, rock material is broken and drilling cuttings are formed in the drill hole 5.

The drilling cuttings needs to be flushed away from the drill hole 5. Typically, pressurized air is produced by means of a compressor CO and the pressurized air is directed via the drilling tool 8 to a bottom of the drill hole 5, whereby drilling cuttings are flushed away. The drilling cuttings can be collected by a means of a duct collecting system 10 having a suction unit 11 for production negative pressure so that the drilling cuttings can be sucked from a drill hole opening 12 via dust collecting tubes 13. There may be a suction basket 14 mountable on the drill hole opening 12 and being connected to the collecting tube 13.

A main purpose of the dust collecting system 10 is to transfer the drilling cuttings away from the drill hole opening 12 so that visibility to the drilled target is good and no difficulties occur for the drilling process due to large amount of the material removed from the drill hole 5. However, the dust collecting system 5 may also have one or more separators for processing the collected material. There may be a first separator 15 for separating coarse particles and a second separator 16 for separating fine particles. The first separator 15 may be mounted on the drilling boom 3 and it may comprise a cyclone, for example. The second separator 16 may be mounted on the carrier 2 in connection with the suction unit 11, for example.

A sampling device 17 for taking samples out of flow of drilling cuttings and air in the system is arranged before the first separator 15, whereby it is located prior to any separation phase. Further, a homogenizer 18 is arranged before the sampling device 17 for ensuring that the flow directed to the sampling device 17 is concentrated. The homogenizer 18 spreads the drilling cuttings in the flow so that proper samples can be taken from the flow. The homogenizer 18 operates by means of pressurized air wherefore pressure air is conveyed from an output port 19 of the compressor CO to a pressure feed line 20 of the homogenizer 18.

The rock drilling rig 1 may have one or more control units CU for controlling the operation and actuators. The control unit CU may control the sampling device 17 and the homogenizer 18, for example. Some control situations and principles are disclosed above. The control unit may have a processor for executing an input computer program product or algorithm, and it may be provided with sensing data and input control parameters.

Figure 2:
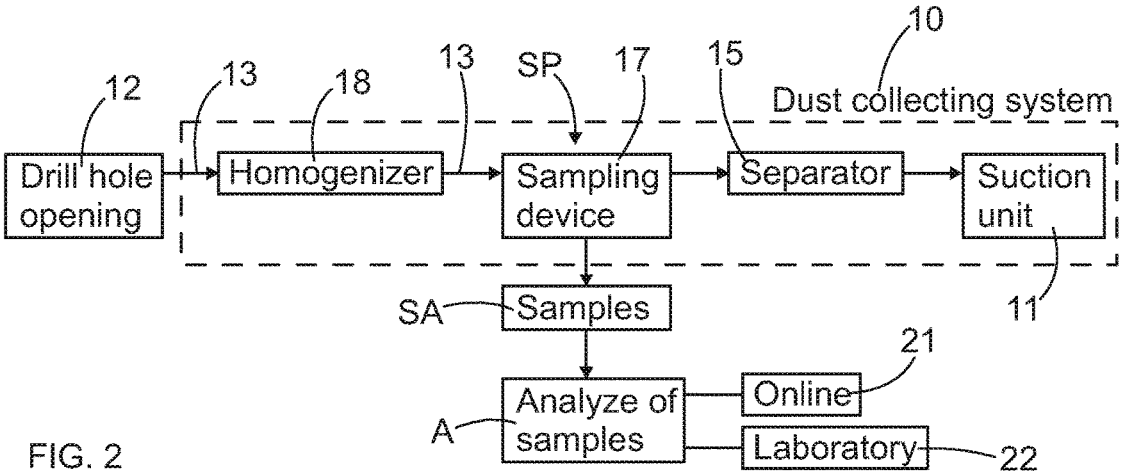
FIG. 2 is a schematic diagram showing basic elements of a dust collecting system and sampling prior executing any separation measures.

FIG. 2 discloses a dust collecting system 10 for sucking drilling cuttings from a drill hole opening 12. The system 10 has dust collecting tubes 13 for transferring the collected flow via a homogenizer 18 to a sampling device 17 and only then to a separator 15. Thus, a sampling point SP is located between the homogenizer 18 and the separator 15. Samples SA are taken from the flow in accordance with a planned sampling schedule or procedure. The samples SA can be analyzed either online at 21 or later on in a laboratory 22.

The sampling device 17 may have a tube or sampling pipe, which is partly insertable inside the flow channel, and which is provided with an opening through which material to be collected passes during the sampling. The samples taken can be stored in receptacles or bags, for example.

Figure 3:
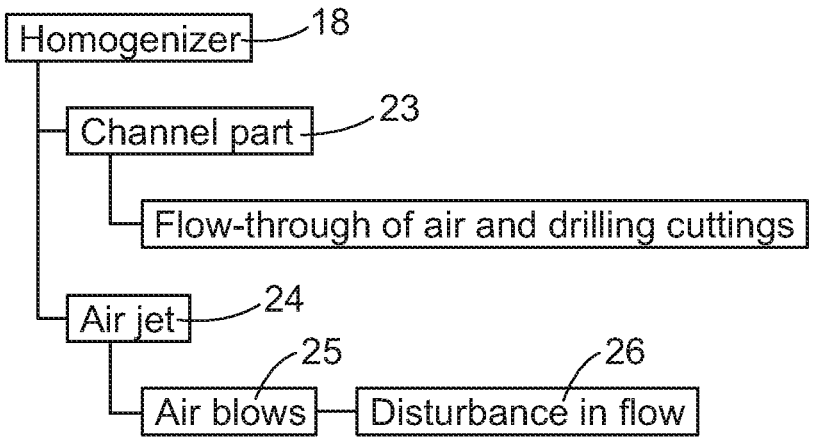
FIG. 3 is a schematic diagram showing some features of a homogenizer.

FIG. 3 discloses that a homogenizer 18 includes a channel part 23 for conveying flow of air and drilling cuttings through it. The channel part 23 is provided with one or more air jets 24 for directing air blows 25 towards the flow and causing thereby desired disturbance 26 in the flow.

Figure 4:
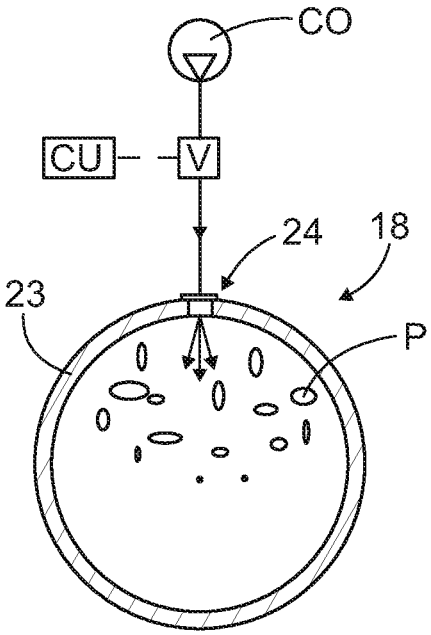
FIGS. 4 and 5 are schematic and cross-sectional views of channel parts of two homogenizers and respective air jet arrangements.

FIG. 4 discloses a homogenizer 18 wherein one air jet 24 is arranged on a wall of a channel part 23. Feeding of pressurized air from a compressor CO can be controlled by means of a valve V, which may be controlled by means of control unit CU. FIG. 4 shows that solid particles P in the flow are not distributed evenly, wherefore the particle distribution needs to be improved by directing air blows in transverse direction to the flow. After this pneumatic particle separation control easier and more reliable sampling is possible.

Figure 5:
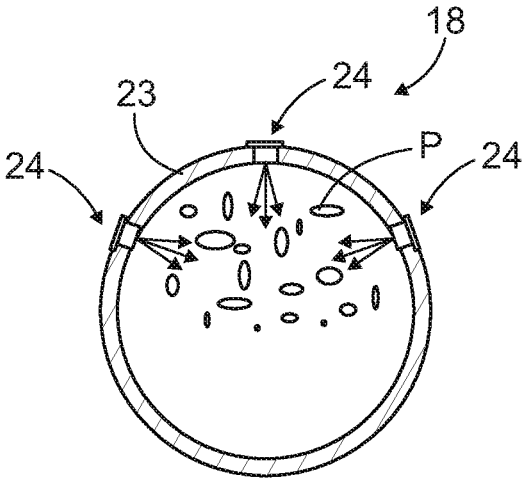

FIG. 5 discloses the same pneumatic control principle as disclosed in FIG. 4, but several air jets are utilized instead of one.

Figure 6:
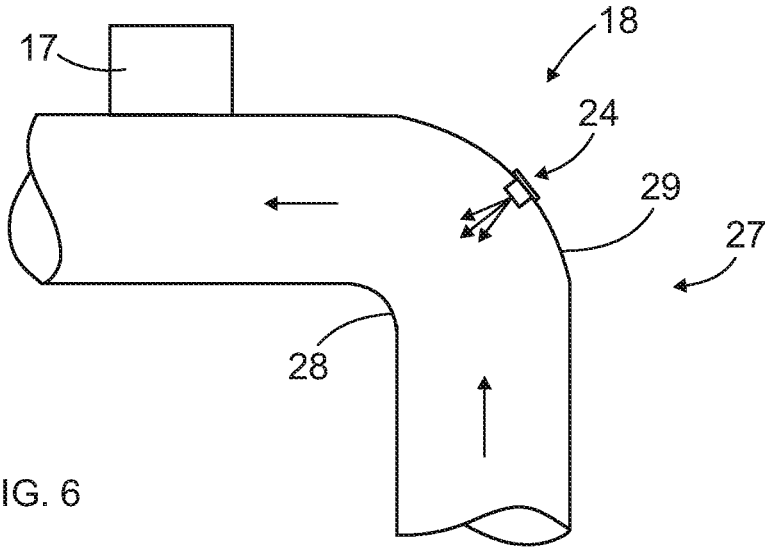
FIGS. 6 and 7 are schematic side views of curved channel parts provided with air jets.
Figure 7:
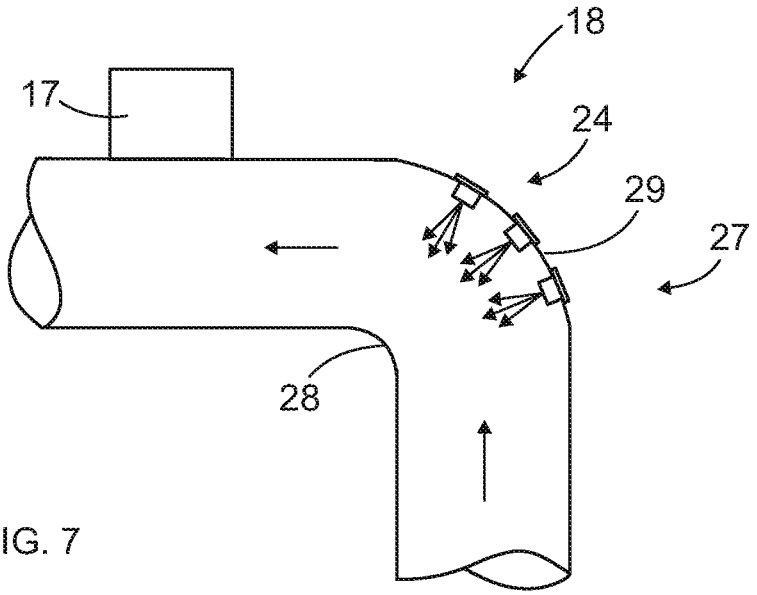

FIGS. 6 and 7 both disclose that a channel part 23 of homogenizer 18 includes a bend 27 provided with an inner curve 28 and an outer curve 29. One or more air jets 24 are mounted on the outer curve 29 of the bend 27. In FIG. 6 the cross-section of the channel part 23 may have one air jet 24 or several air jets arranged in different radial angles. In FIG. 7 there are several air jets 24 arranged one after each other in longitudinal direction of the bend 27.

Figure 8:
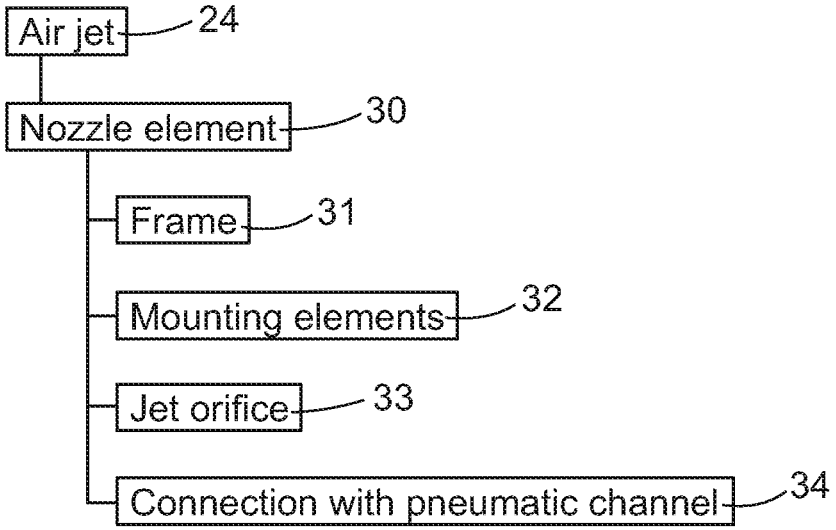
FIG. 8 is a schematic diagram of some features of an air jet.

FIG. 8 discloses that air jet 24 may have a nozzle element 30 including a frame 31 or body and mounting elements 32 for mounting it to a channel part. Further, there are one or more jet orifices 33 through which the air blows are directed. The nozzle element 30 is provided with a feed port or connection 34 for connecting it with a pneumatic channel for feeding pressure air.

In one example, mounting of the nozzle element 30 includes drilling a hole in a wall of the channel part, inserting the nozzle element 30 into the drilled hole and tightening the nozzle element 30 in place with screw members. Finally, the nozzle element is connected to the pneumatic channel.

Although the present embodiments have been described in relation to particular aspects thereof, many other variations and modifications and other uses will become apparent to those skilled in the art. It is preferred therefore, that the present embodiments be limited not by the specific disclosure herein, but only by the appended claims.

The invention claimed is:

1. A rock drilling rig comprising:

a movable carrier;

at least one drilling boom mounted on the carrier and including a rock drilling unit provided with a rock drilling machine;

a dust collecting system arranged for removing drilling cuttings from an opening of a drilled hole, wherein the dust collecting system is provided with a suction unit, dust collecting tubing, and at least one separator for separating solid particles from flow containing air and the drilling cuttings;

at least one sampling point for taking samples of the flow, wherein the sampling point is located prior to the separator so that the flow is still unseparated at the sampling point; and a homogenizer in the dust collecting system preceding the sampling point, the homogenizer including a channel part through which the flow is directed; and at least one air jet arranged on an inner surface of the channel part arranged for directing air blows to the flow for generating a disturbance in the flow and to thereby homogenize particle distribution of the drilling cuttings in the flow.

2. The rock drilling rig as claimed in claim 1, wherein the channel part includes a bend and the at least one air jet is located at the bend.

3. The rock drilling rig as claimed in claim 1, wherein the channel part includes a bend with an inner curve and an outer curve, and wherein the at least one air jet is provided on the outer curve of the bend.

4. The rock drilling rig as claimed in claim 1, wherein the at least one air jet comprises several air jets in transverse cross-section of the channel part, whereby the several air jets are orientated in different radial directions relative to each other.

5. The rock drilling rig as claimed in claim 1, wherein the magnitudes of the air blows of the at least one air jet is controllable under control of a control unit.

6. The rock drilling rig as claimed in claim 1, further comprising at least one compressor arranged for generating pneumatic pressure to a pneumatic system and wherein the homogenizer is connected to the pneumatic system and is controllable by at least one control valve.

7. A method of sampling in a rock drilling rig, wherein the method comprises:

drilling drill holes in a rock surface;

collecting produced drilling cuttings from an opening of the drill holes during the drilling by means of a dust collecting system;

taking samples of flow containing air and drilling cuttings at a sampling point of the dust collecting system during the drilling;

providing the dust collecting system with a homogenizer before the sampling point;

directing transverse air blows to the flow and thereby spreading drilling cutting particles in the flow to even out particle distribution of the flow; and taking the samples downstream the mentioned particle spreading.

8. The method as claimed in claim 7, comprising controlling the spreading of the solid particles in the flow by directing several air blows in different transverse directions towards the flow.

9. The method as claimed in claim 7, comprising providing the at least one air jet with continuous air flow during the selectively controlled spreading measures of the solid particles.

10. The method as claimed in claim 7, comprising directing pressure air pulses or impacts to the flow when executing the spreading of the solid particles.

* * * * *